US010639516B2

(12) United States Patent
Thomas et al.

(10) Patent No.: US 10,639,516 B2
(45) Date of Patent: May 5, 2020

(54) MULTI-SPORT ATHLETIC RESISTANCE TRAINING BELT

(71) Applicants: Jason Thomas, Oklahoma City, OK (US); Willie Hurst, Oklahoma City, OK (US); Blair Thomas, Oklahoma City, OK (US)

(72) Inventors: Jason Thomas, Oklahoma City, OK (US); Willie Hurst, Oklahoma City, OK (US); Blair Thomas, Oklahoma City, OK (US)

( * ) Notice: Subject to any disclaimer, the term of this patent is extended or adjusted under 35 U.S.C. 154(b) by 171 days.

(21) Appl. No.: 15/821,324

(22) Filed: Nov. 22, 2017

(65) Prior Publication Data

US 2018/0140892 A1 May 24, 2018

Related U.S. Application Data

(60) Provisional application No. 62/425,880, filed on Nov. 23, 2016.

(51) Int. Cl.
*A63B 21/00* (2006.01)
*A63B 21/08* (2006.01)
(Continued)

(52) U.S. Cl.
CPC ..... *A63B 21/4009* (2015.10); *A63B 21/0004* (2013.01); *A63B 21/0442* (2013.01);
(Continued)

(58) Field of Classification Search
CPC .. A63B 5/00; A63B 5/16; A63B 5/166; A63B 2005/163; A63B 7/00; A63B 7/02; A63B 19/00; A63B 19/02; A63B 19/04; A63B 21/0004; A63B 21/00058; A63B 21/00061; A63B 21/00065; A63B 21/00069; A63B 21/00072; A63B 21/00076; A63B 21/00181; A63B 21/00185; A63B 21/002; A63B 21/0023; A63B 21/02; A63B 21/021; A63B 21/028; A63B 21/04; A63B 21/0407; A63B 21/0414; A63B 21/0421; A63B 21/0428;
(Continued)

(56) References Cited

U.S. PATENT DOCUMENTS 2,999,333 A * 9/1961 Clark ..... A63B 19/00 446/28
3,509,660 A * 5/1970 Seymour ..... A63B 19/00 446/38
(Continued)

*Primary Examiner* — Gary D Urbiel Goldner
(74) *Attorney, Agent, or Firm* — Cantor Colburn LLP

(57) ABSTRACT

An athletic training belt including: a first part comprising a radially internal and radially constrictable waist belt; a second part connected to the first part, the second part being a radially external and circumferentially rigid annular frame, wherein the annular frame includes an annular track, a mechanical connector that slidably moves about the track, and an aperture for connecting with athletic training equipment; wherein the annular frame comprises frame portions that move relative to each other, wherein the training belt is reversibly closable to form an annular loop; and a third part fixedly connected to a radially internal surface of the annular frame, wherein the third part flexibly connects the waist belt to the annular frame.

26 Claims, 14 Drawing Sheets

(51) Int. Cl.

| | |
|---|---|
| ***A63B 21/04*** | (2006.01) |
| ***A63B 21/055*** | (2006.01) |
| ***A63B 23/035*** | (2006.01) |
| ***A63B 23/04*** | (2006.01) |
| ***A63B 21/02*** | (2006.01) |

(52) U.S. Cl.
CPC ..... *A63B 21/055* (2013.01); *A63B 21/08* (2013.01); *A63B 21/4025* (2015.10); *A63B 21/4039* (2015.10); *A63B 23/03541* (2013.01); *A63B 23/03575* (2013.01); *A63B 21/028* (2013.01); *A63B 23/047* (2013.01); *A63B 2209/00* (2013.01); *A63B 2209/10* (2013.01); *A63B 2225/09* (2013.01); *A63B 2225/62* (2013.01)

(58) Field of Classification Search
CPC ..... A63B 21/0435; A63B 21/0442; A63B 21/055; A63B 21/0552; A63B 21/0555; A63B 21/0557; A63B 21/0608; A63B 21/065; A63B 21/068; A63B 21/08; A63B 21/15; A63B 21/151; A63B 21/152; A63B 21/154; A63B 21/155; A63B 21/156; A63B 21/157; A63B 21/159; A63B 21/16; A63B 21/22; A63B 21/222; A63B 21/4009; A63B 21/4023; A63B 21/4025; A63B 21/4027; A63B 21/4039; A63B 21/4041; A63B 21/4043; A63B 21/4045; A63B 21/4047; A63B 21/4049; A63B 22/18; A63B 22/20; A63B 22/201; A63B 22/205; A63B 22/208; A63B 2022/206; A63B 2023/003; A63B 2023/006; A63B 23/02; A63B 23/0205; A63B 23/0211; A63B 23/0216; A63B 23/0222; A63B 23/0227; A63B 23/0233; A63B 23/0238; A63B 23/035; A63B 23/03508; A63B 23/03516; A63B 23/03533; A63B 23/03541; A63B 23/0355; A63B 23/03575; A63B 23/04; A63B 23/0405; A63B 23/047; A63B 23/0482; A63B 23/0494; A63B 23/12; A63B 23/1209; A63B 23/1245; A63B 23/1281; A63B 69/0057; A63B 69/0059; A63B 69/0064; A63B 71/0054; A63B 2071/0063; A63B 2071/0072; A63B 2071/0081; A63B 2071/009; A63B 2209/00; A63B 2209/10; A63B 2209/14; A63B 2225/09; A63B 2225/093; A63B 2225/62
See application file for complete search history.

(56) References Cited

U.S. PATENT DOCUMENTS

| | | | | | |
|---|---|---|---|---|---|
| 3,868,786 | A * | 3/1975 | Lippe | A01K 27/001 | 446/28 |
| 4,204,719 | A * | 5/1980 | Murphy | A61H 3/008 | 104/62 |
| 4,275,880 | A * | 6/1981 | Murphy | A61H 3/008 | 482/43 |
| 4,340,215 | A * | 7/1982 | Murphy | A61H 3/008 | 104/62 |
| 4,340,216 | A * | 7/1982 | Murphy | A61H 3/008 | 105/150 |
| 4,356,902 | A * | 11/1982 | Murphy | A61H 3/008 | 193/35 R |
| 5,733,231 | A * | 3/1998 | Corn | A63B 21/025 | 482/120 |
| 6,095,936 | A * | 8/2000 | Kirkpatrick | A63B 69/0071 | 434/248 |
| 6,368,296 | B1 * | 4/2002 | Eiter | A63B 21/4009 | 482/146 |
| 7,758,480 | B1 * | 7/2010 | Chen | A63B 19/00 | 482/105 |
| 8,784,230 | B1 * | 7/2014 | Mitchell | A63B 69/0057 | 473/271 |
| 9,517,156 | B2 * | 12/2016 | Marzilger | A61F 5/37 | |
| 9,687,688 | B2 * | 6/2017 | Hsiao | A63B 19/00 | |
| 9,873,015 | B2 * | 1/2018 | Jolly | A63B 23/025 | |
| 2006/0172657 | A1 * | 8/2006 | Chen | A63B 19/00 | 446/236 |
| 2013/0085041 | A1 * | 4/2013 | Jolly | A63B 23/025 | 482/10 |
| 2013/0085046 | A1 * | 4/2013 | Jolly | A63B 23/025 | 482/129 |
| 2014/0342882 | A1 * | 11/2014 | Huang | A63B 21/22 | 482/110 |
| 2015/0080187 | A1 * | 3/2015 | Beane | A63B 69/0064 | 482/51 |
| 2015/0126344 | A1 * | 5/2015 | Wehrell | A63B 23/047 | 482/128 |
| 2015/0251038 | A1 * | 9/2015 | Bybee | A63B 21/0442 | 482/124 |
| 2016/0045778 | A1 * | 2/2016 | Dwork | A63B 21/16 | 482/96 |

* cited by examiner

MULTI-SPORT ATHLETIC RESISTANCE TRAINING BELT

CROSS REFERENCE TO RELATED APPLICATION

This application claims the benefit of U.S. Provisional Patent Application Ser. No. 62/425,880, filed on Nov. 23, 2016, the contents of which are incorporated herein by reference in their entirety.

BACKGROUND

1. Field

This disclosure relates to a multi-sport athletic resistance training belt.

2. Description of the Related Art

Athletic training devices are available in a variety of shapes and sizes with varying purposes. For example some devices are intended to develop power, others are intended to develop the speed, whereas others are intended to develop agility. Also, many such devices are specifically designed for training associated with a particular sport. Nonetheless there remains a need for an improved training device.

SUMMARY

Disclosed is an athletic training belt including: a first part comprising a radially internal and radially constrictable waist belt; a second part connected to the first part, the second part being a radially external and circumferentially rigid annular frame, wherein the annular frame includes an annular track, a mechanical connector that slidably moves about the track, and an aperture for connecting with athletic training equipment; wherein the annular frame comprises frame segments that move relative to each other, wherein the training belt is reversibly closable to form an annular loop; and a third part fixedly connected to a radially internal surface of the annular frame, wherein the third part flexibly connects the waist belt to the annular frame.

Also disclosed is an athletic training apparatus including: an adjustable pad, the adjustable pad including a plastic strap with a serrated portion at a first end, a latch rigidly fixed to a second end of the strap and comprising a buckle which engages the serrated strap end, and a pad encircling the strap; a track disposed outside of the pad, the track including at least two semicircular rigid members, at least two hingedly attached rigid upper sections, at least two hingedly attached rigid lower sections, a track cavity defined by rigidly affixing the upper and lower sections to the semicircular rigid members with sufficient spacing between the sections adapted to receive a trackball therein allowing free movement around the track, and an upper latch fixedly attached to the upper sections and an lower latch fixedly attached to the lower sections adapted to draw the section ends together, creating a continuous track; a roller assembly including the trackball received within the track cavity affixed to an eyelet that extends outside the cavity; and connectors attaching the adjustable pad to the track.

BRIEF DESCRIPTION OF THE DRAWINGS

The above and other advantages and features of this disclosure will become more apparent by describing in further detail exemplary embodiments thereof with reference to the accompanying drawings, in which:

FIG. 4A is an embodiment of a track stop;

FIG. 10 is an exploded view of the embodiment of a resistance training belt with adjustable padding in an open configuration;

DETAILED DESCRIPTION

Figure 1:
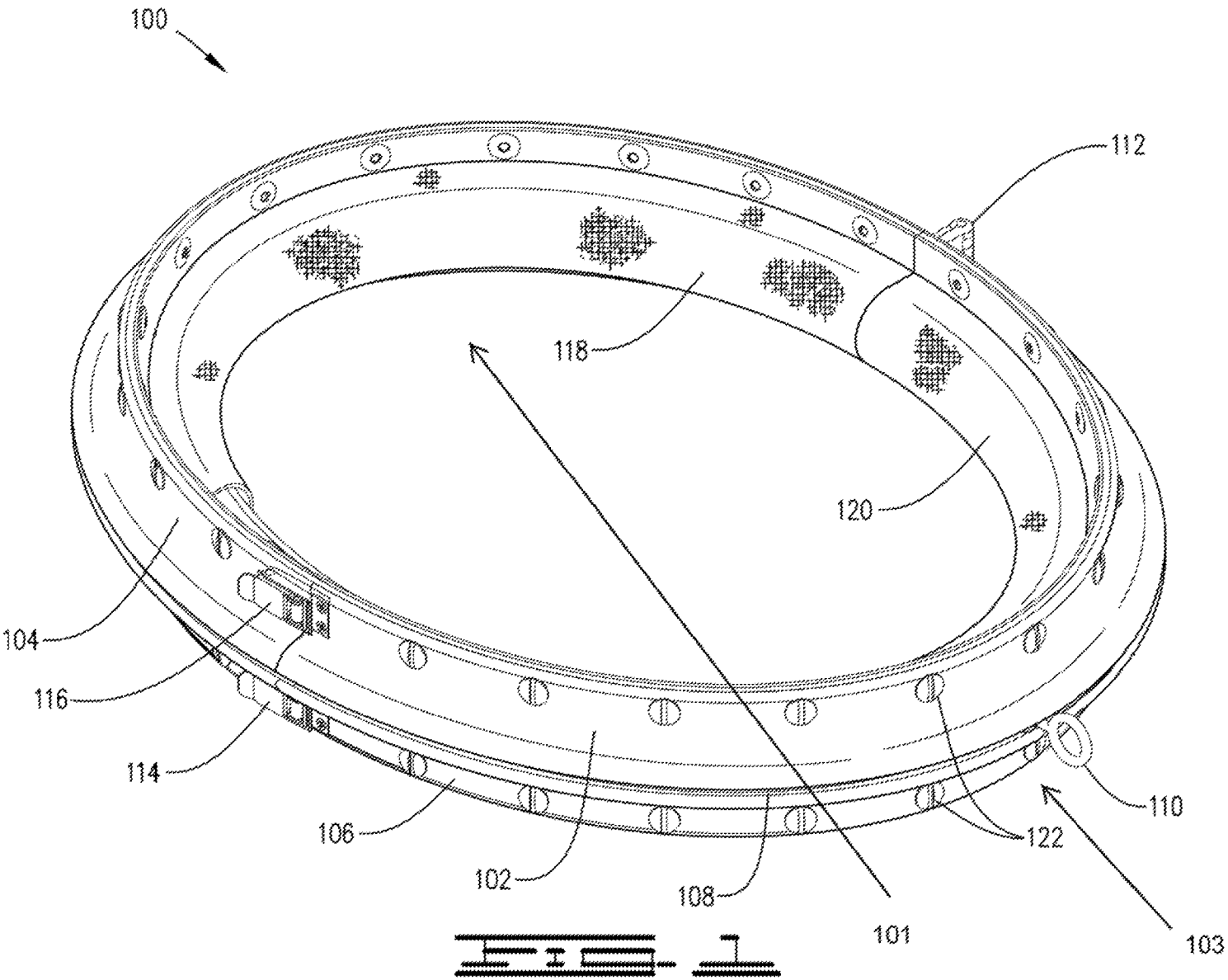
FIG. 1 is a perspective view of an embodiment of a resistance training belt.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

Training belts may be limited by having multiple static discrete attachment points. After a specific exercise or training scenario, when a training belt having static attachment points is used, a user or trainer may stop or pause training to make a connection to a different static point for the next exercise or training scenario. Such readjustments are undesirable because they can reduce the time available for training.

Disclosed is an athletic training belt comprising: a first part that is a radially internal, and radially constrictable, waist belt; a second part connected to the waist belt, the second part being a radially external, and circumferentially rigid, annular frame; the annular frame including an annular track, a mechanical connector that slidably moves about the track, and apertures for connecting with athletic training equipment; the annular frame comprising frame segments that are selectively separable and move relative to each other, whereby the training belt is closable to form an annular loop around the waist of a user and openable to be positioned against or removed from the waist of a user; a third part fixedly connected to a radial internal surface of the annular frame and which flexibly connects the waist belt to the annular frame.

In addition to one or more of the features described above, or as an alternative, the frame segments may comprise at least two of the frame segments that may have a substantially same circumferential span, pivotally connected at a first circumferential end of the frame segments, and releasably connected at a second circumferential end of the frame segments. When the frame segments have the same circumferential span, the frame segments may be referred to as half frames.

In addition to one or more of the features described above, or as an alternative, further embodiments may include that the frame segments each include: a backer plate on a radial inner side of the annular frame, an axial upper shell and an axial lower shell, both shells disposed on a radial outer side of the annular frame and connected to the backer plate to provide an annular gap at an axial center of the training belt to form the track, wherein axial adjacent portions of the shells include a substantially quarter-circle profile that is substantially constant along the annular track, and wherein the annular frame includes: a trackball disposed on a radial inner side of the track, with a stem that extends radially through the tack and connects the mechanical connector to the track.

In addition to one or more of the features described above, or as an alternative, further embodiments may include an additional pair of anchor balls disposed on the radial inside of the track, each with a stem that extends radially through the track and connects with a butterfly nut, to limit a travel span of the mechanical connector in the track.

In addition to one or more of the features described above, or as an alternative, further embodiments may include that the shells and the backer plate are connected by two sets of circumferentially spaced connectors, wherein one connector set is disposed on each axial outer portion of the shells, axially adjacent to the quarter-circle profile.

In addition to one or more of the features described above, or as an alternative, further embodiments may include that the apertures include any suitable number of apertures, such as 2 to 20 apertures, such as 8 apertures, pairs of which may be disposed on each shell, axially aligned with each set of connectors, and circumferentially spaced about each shell so that each aperture in the upper shells is axially aligned with each aperture the lower shells.

In addition to one or more of the features described above, or as an alternative, further embodiments may include that the frame segments are releasably connected by a fastener connection that includes a toggle latch on one of the second ends of the frame segments and a latch strike on another of the second ends of the frame segments.

In addition to one or more of the features described above, or as an alternative, further embodiments may include that the fastener connection includes two sets of fasteners connections, including two toggle latches on one of the second ends of the frame segments and two latch strikes on another of the second ends of the frame segments, each connector set being disposed on the axial outer portion of the shells, and axially aligned with one connector set.

In addition to one or more of the features described above, or as an alternative, further embodiments may include that the waist belt comprises a strap with a gear toothed end and a releasable, self-locking, ratchet end.

In addition to one or more of the features described above, or as an alternative, an embodiment may include that the third part comprises an elastic band, opposing axial ends of which are disposed against a radial inner surface of the backer plate, sandwiched between the backer plate and rigid arcuate edge strips, and secured by the circumferentially spaced connectors.

In addition to one or more of the features described above, or as an alternative, an embodiment may include that the elastic band extends circumferentially about the annular frame, and is segmented at the pivotal connection, so that when the training belt is closed, the toothed end and ratchet end of the waist belt are exposed, and the remainder of the waist belt is between the elastic band and the annular frame.

In addition to one or more of the features described above, or as an alternative, further embodiments may include a padding insert, such as 2 to 10 padding inserts, which are connectible on a radially internal facing surface of the elastic band to further radially constrict the waist belt. The padding insert may be connectable to the elastic band via one or more of hook and loop connectors and/or stud and socket snap connectors.

In addition to one or more of the features described above, or as an alternative, an embodiment may include that the elastic band includes one of hook and loop connectors, the padding insert includes one of stud and socket connectors, and the training belt further comprises an intermediate member having another of the hook and loop connectors on a radial outer side and another of the stud and socket connectors on a radial inner side, thereby connecting the padded inserts to the elastic band.

In addition to one or more of the features described above, or as an alternative, an embodiment may include an inflatable bladder disposed on a radially internal facing surface of the elastic band to further radially constrict the waist belt, and an actuated air pump, such as a manually actuated air pump, for inflating and deflating each bladder.

In addition to one or more of the features described above, or as an alternative, an embodiment may include that the inflatable bladder includes any suitable number of inflatable bladders, such as ten (10) to twenty (20) inflatable bladders, for example two (2) inflatable bladders, disposed on the radially internal facing surface of the elastic band 109 on each of the frame segments.

In addition to one or more of the features described above, or as an alternative, an embodiment may include a control for the air pump which may be disposed on one of the axial upper shells, proximate to the second end of the frame segments.

Also disclosed is an athletic training apparatus comprising: an adjustable pad for securing the training apparatus to a user's body having—a plastic strap with a serrated portion at a first end, a latch rigidly fixed to a second end of the strap adapted to be adjusted to the body wherein the buckle engages the serrated strap end at a desired position to prevent slippage, and a pad encircling the strap, positioned between the body and the strap; a track disposed outside of the pad having two semicircular rigid members; two hingedly attached rigid upper sections, two hingedly attached rigid lower sections, a track cavity defined by rigidly affixing the upper and lower sections to the semicircular rigid members with sufficient spacing between the sections adapted to receive a trackball therein allowing free movement around the track, and an upper latch fixedly attached to the upper sections and an lower latch fixedly attached to the lower sections adapted to draw the section ends together, creating a continuous track around the body; a roller assembly including the trackball received within the track cavity affixed to an eyelet that extends outside the cavity; connectors attaching the adjustable pad to the track, and whereby a user may unlatch and open the track system and open the adjustable pad to place the training apparatus around the body, secure the adjustable pad to the body, close and latch the track system, and attach a line to the roller eyelet wherein a trainer may provide resistance to the user while performing an athletic move such as rotating the user's body while trying to catch a ball.

In addition to one or more of the features described above, or as an alternative, further embodiments may include that the adjustable pad is selected from a group consisting leather, or a polymer.

In addition to one or more of the features described above, or as an alternative, an embodiment may include that the elastic member is selected from at least one of natural rubber, and a polymer based on chloroprene, isobutylene, and isoprene.

Further disclosed is an athletic training apparatus allowing a user to pull a training load with a line, the apparatus comprising: a track having an internal circumference encircling a portion of the user's body; attachment means for releasably affixing the track around the user's body; a roller assembly rollingly engaging the track around its entire circumference; and a connection point affixed to the roller assembly and engaging a first end of a line; whereby a user wearing the apparatus can affix a second end of the line to the training load then pull the load while manipulating their body through turns facilitated by rolling engagement of the roller assembly around the track.

In addition to one or more of the features described above, or as an alternative, an embodiment may include a pad affixed to the track and the user's body, wherein the internal circumference of the pad is adjustable to accommodate different users.

In addition to one or more of the features described above, or as an alternative, an embodiment may include that the pad further comprises an attachment means for releasably affixing the apparatus around the a user's body.

An athletic training belt 100 is disclosed in FIG. 1. The training belt 100 includes a first part 101 that is a radially internal, and radially constrictable, waist belt. A second part is 103 connected to the waist belt 101, the second part being a radially external, and circumferentially rigid, annular frame 103.

Figure 4:
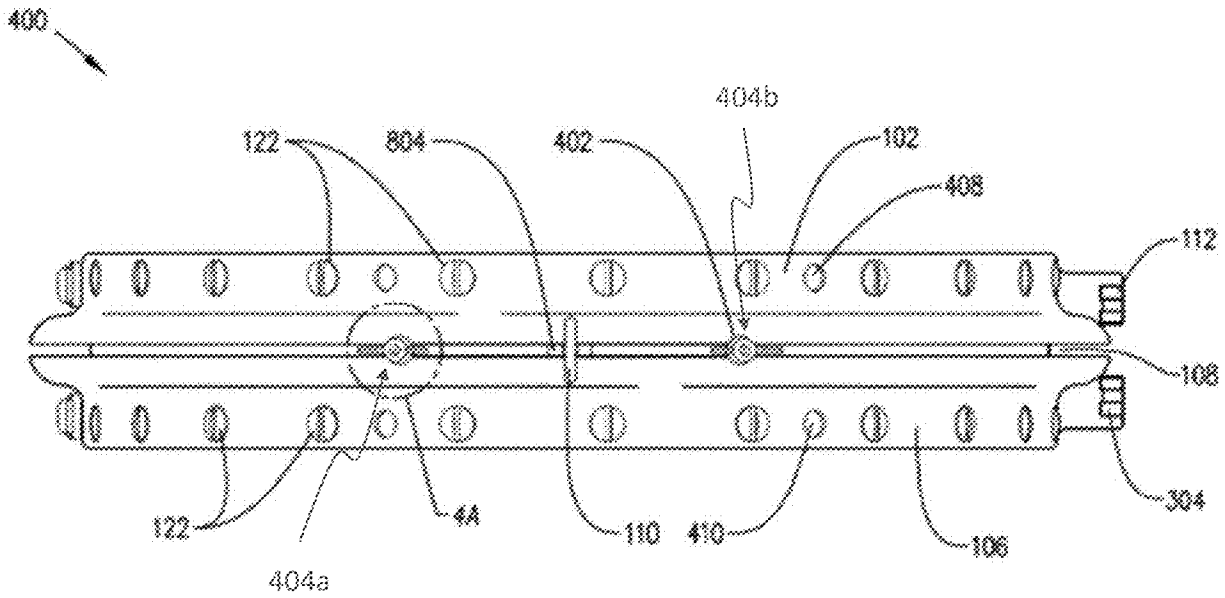
FIG. 4 is a side view of the resistance training belt shown in FIG. 1.
Figure 13:
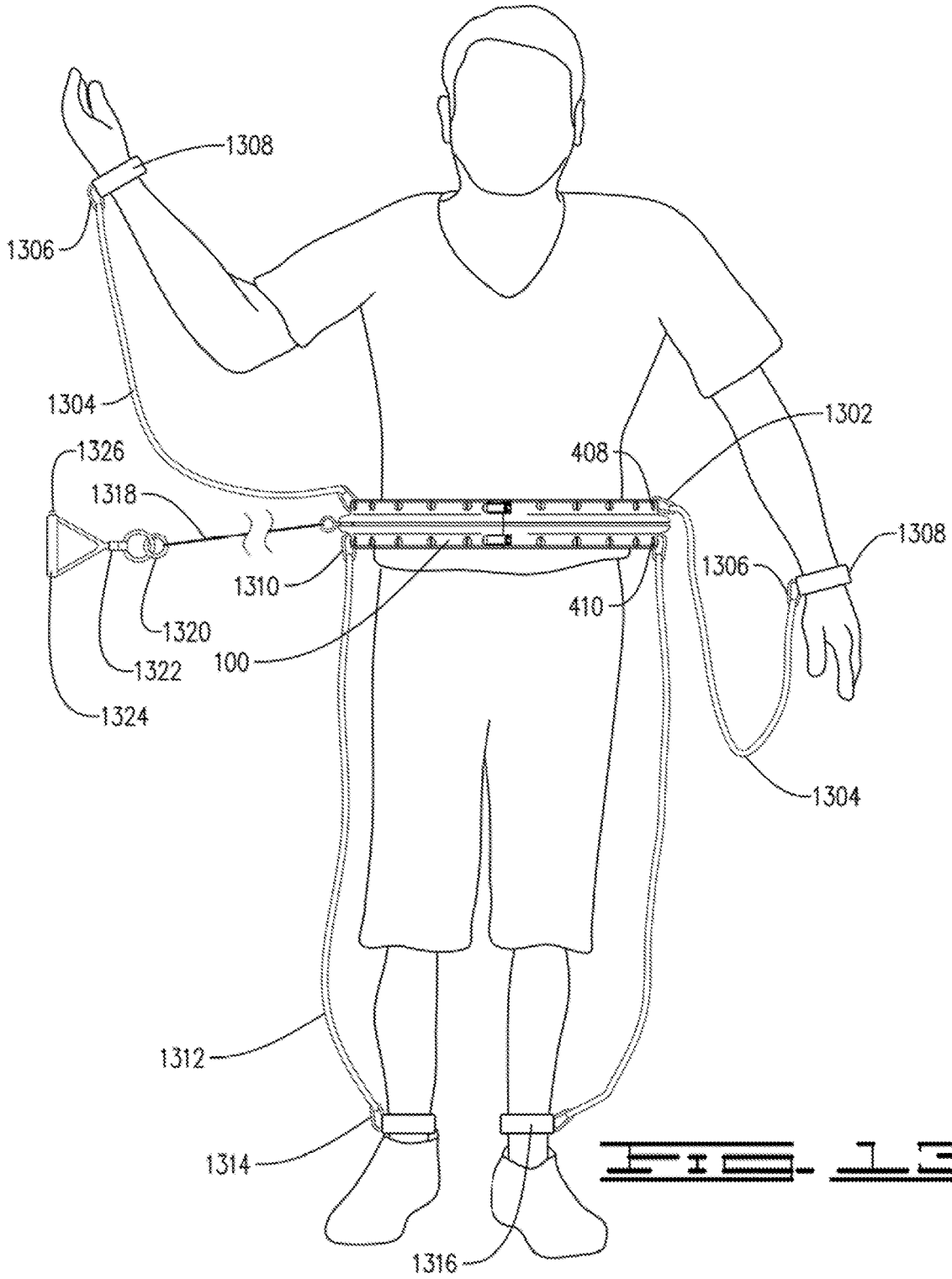
FIG. 13 is shows an embodiment of the resistance training belt with arm and leg training bands mounted to a user.

The annular frame 103 includes an annular track 108. A mechanical connector 110 slidably moves about the track 108. Additionally, apertures 408, 410, as shown in FIG. 4, for connecting with athletic training equipment, as shown in FIG. 13, are disposed about the annular frame 103.

Figure 2:
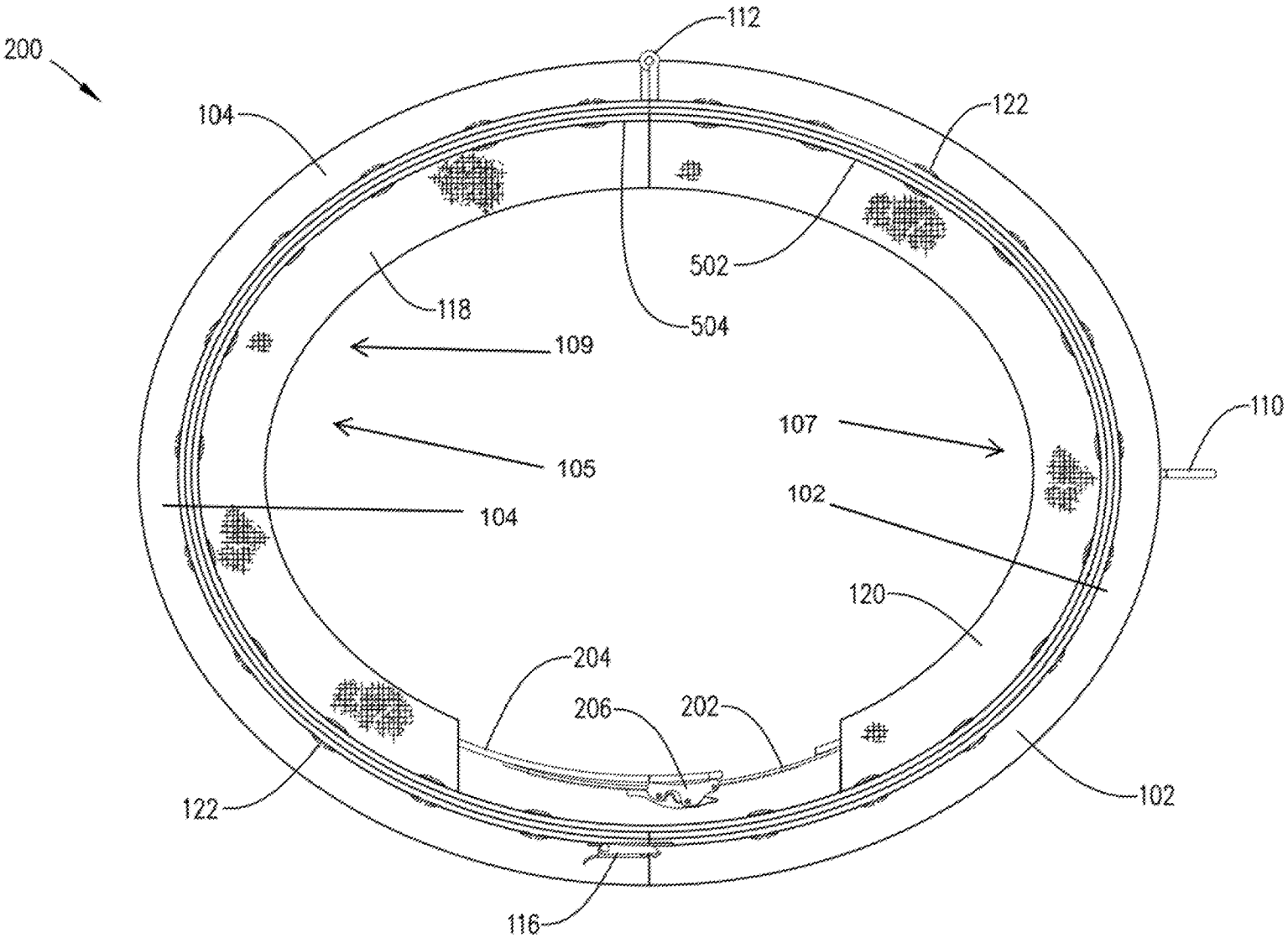
FIG. 2 is a top view of the resistance training belt shown in FIG. 1.
Figure 5:
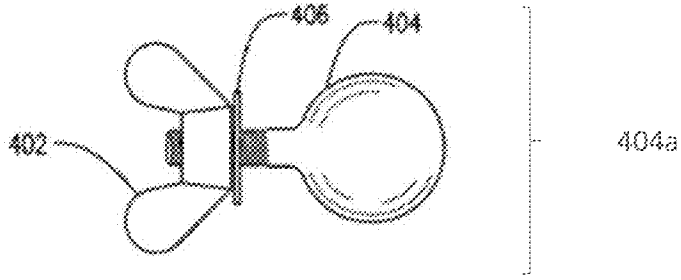
FIG. 5 is a perspective view of an embodiment of the resistance training belt in an open configuration.
Figure 5:
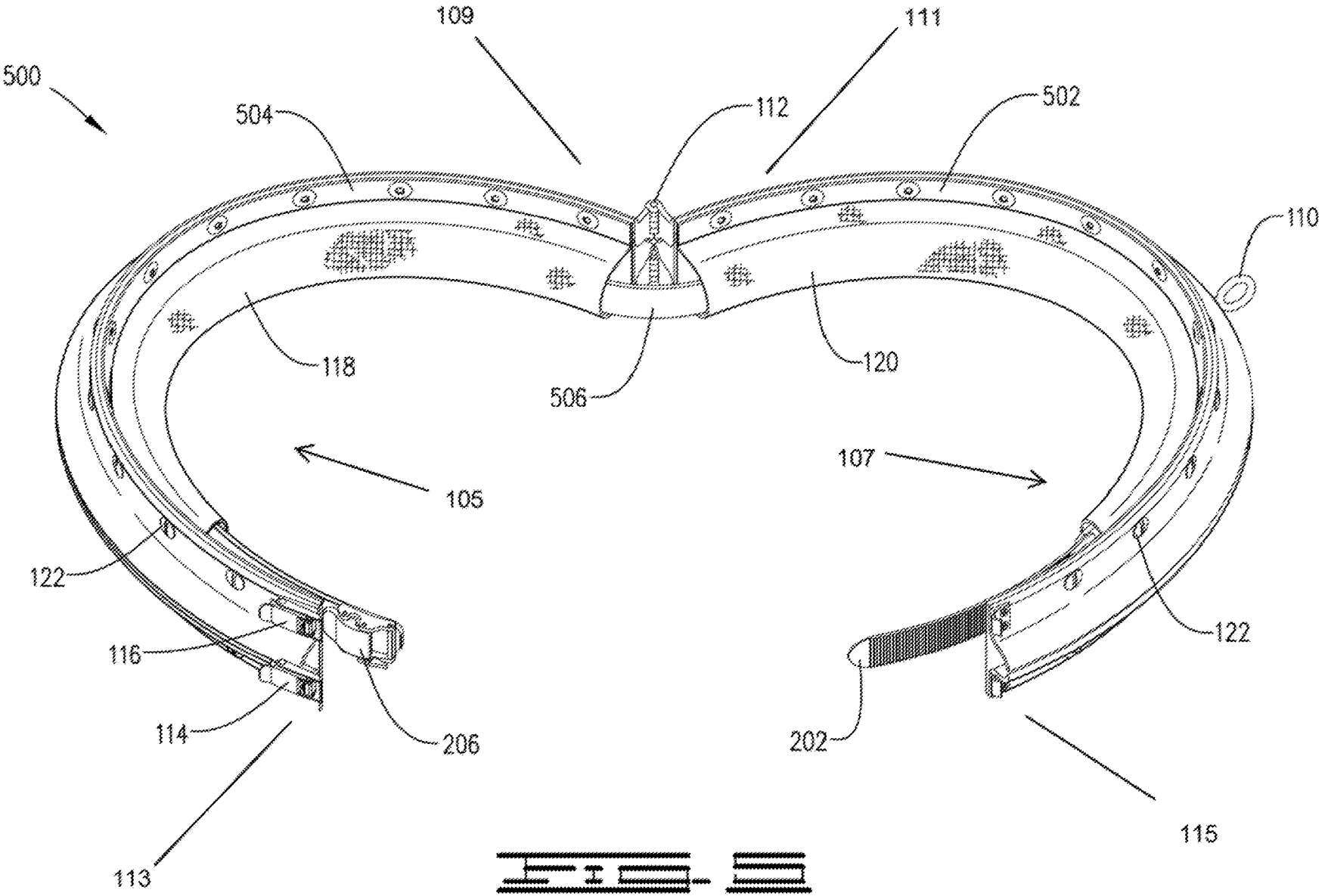

The annular frame 103 includes frame segments (or frame portions) 105, 107 that are selectively separable and move relative to each other, as shown in FIGS. 2 and 5. From this configuration, the training belt 100 is closable to form an annular loop around the waist of a user and openable to be positioned against or removed from the waist of a user.

The training belt 100 also includes third part 109, as shown in FIG. 2, fixedly connected to a radially internal surface of the annular frame 103. The third part 109 flexibly connects the waist belt 101 to the annular frame 103.

The frame segments 105, 107 include two of the frame segments 105, 107, wherein each may have a substantially same circumferential span. When the frame segments 105, 107 have the same circumferential span, the frame segments 105, 107 may be referred to as half frames. The fame segments 105, 107 are pivotally connected, as shown in FIG. 5, at first circumferential end 109, 111 of the frame segments 105, 107. On the other hand, the frame segments 105, 107 are releasably connected at a second circumferential end 113, 115 of the frame segments 105, 107.

Figure 3:
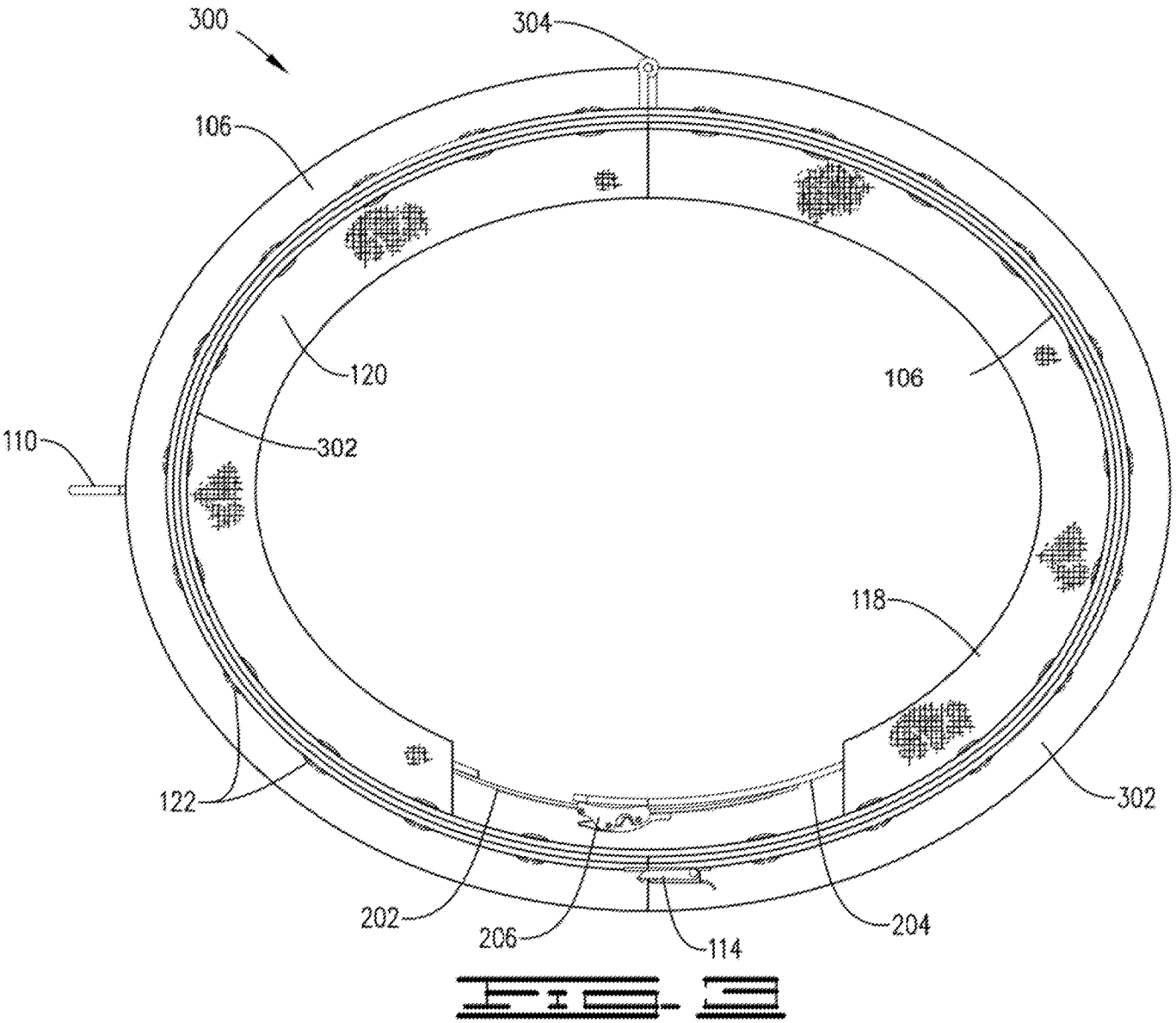
FIG. 3 is a bottom view of the resistance training belt shown in FIG. 1.
Figure 8:
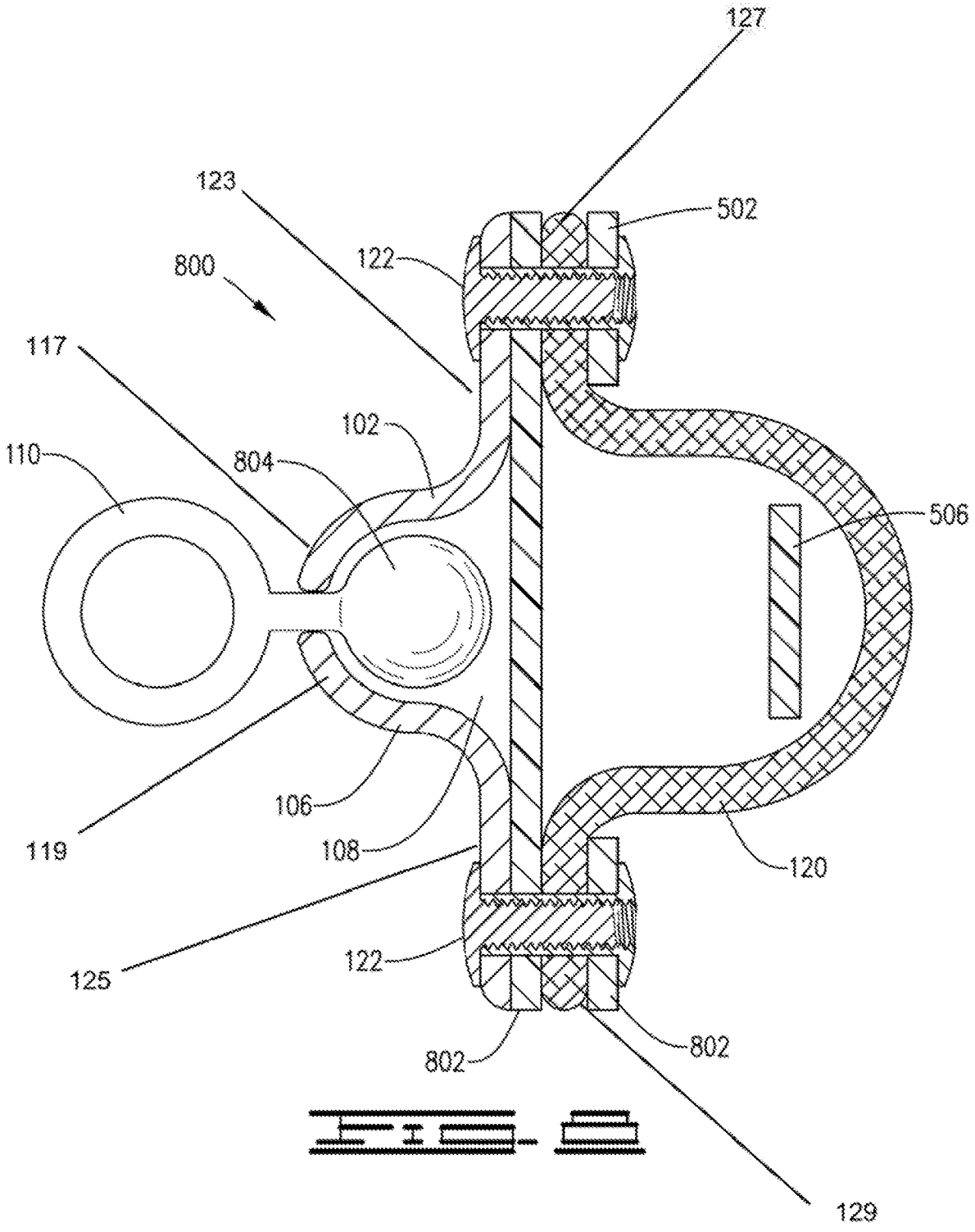
FIG. 8 is a cross-sectional view of the resistance training belt of FIG. 1.

The frame segments 105, 107 each include a backer plate 802, as shown in FIG. 8, on a radial inner side of the annular frame 103, an axial upper shell 102, 104, as shown in FIG. 2, and an axial lower shell 106, 302, as shown in FIG. 3. Both sets of shells 102, 104, 106, 302 are disposed on a radial outer side of the annular frame 103 and connected to the backer plate 802 to provide an annular gap at an axial center of the training belt 100. The gap forms the track 108.

Axial adjacent portions of the shells, as shown in FIG. 8, include a substantially quarter-circle profile 117, 119 that is substantially constant along the annular track 108. The annular frame 103 includes a trackball 804 disposed on a radial inner inside of the track 108, with a stem that extends radially through the track 108 and connects the mechanical connector 110 to the track 108.

An additional pair of anchor balls (with one anchor ball 404 shown in FIG. 4A) maybe disposed on the radial inner side of the track 108. Each of the additional anchor balls 404 is part of a track stop 404*a*, discussed in greater detail below, with a pair of track stops 404*a*, 404*b* illustrated in FIG. 4. Each track stop 404*a* includes an anchor ball 404, a stem that extends radially through the track 108 and connects with a butterfly nut 402. Each butterfly nut 402 is locked at a desired location around the track 108 to limit a travel span of the mechanical connector 110 in the track 108.

The shells 102, 104, 106, 302 and the backer plate 802 are connected by two sets of circumferentially spaced connectors 122, as shown in FIG. 8. One connector set may be disposed on each axial outer portion 123, 125 of the shells 102, 104, 106, 302, axially adjacent to the quarter-circle profile 117, 119.

The apertures 408, 410, as shown in FIG. 4, include eight apertures, pairs of which are disposed on each shell 102, 104, 106, 302, axially aligned with each set of circumferentially spaced connectors 122. The apertures 408, 410 are circumferentially spaced about each shell 102, 104, 106, 302 so that each aperture 408, 410 in the upper shells 102, 104 is axially aligned with each aperture the lower shells 106, 302.

Figure 6:
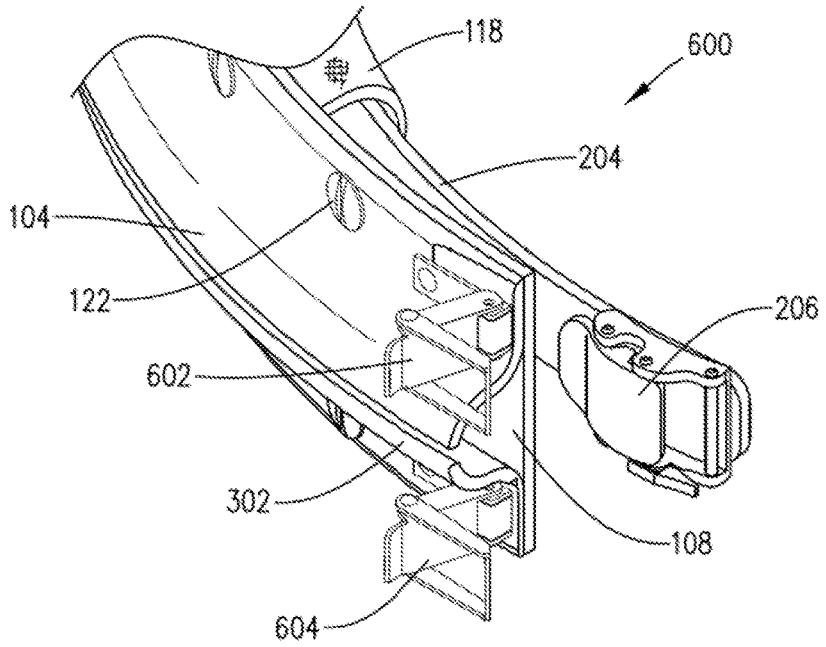
FIG. 6 is a perspective view of an embodiment of a draw latch belt end.
Figure 7:
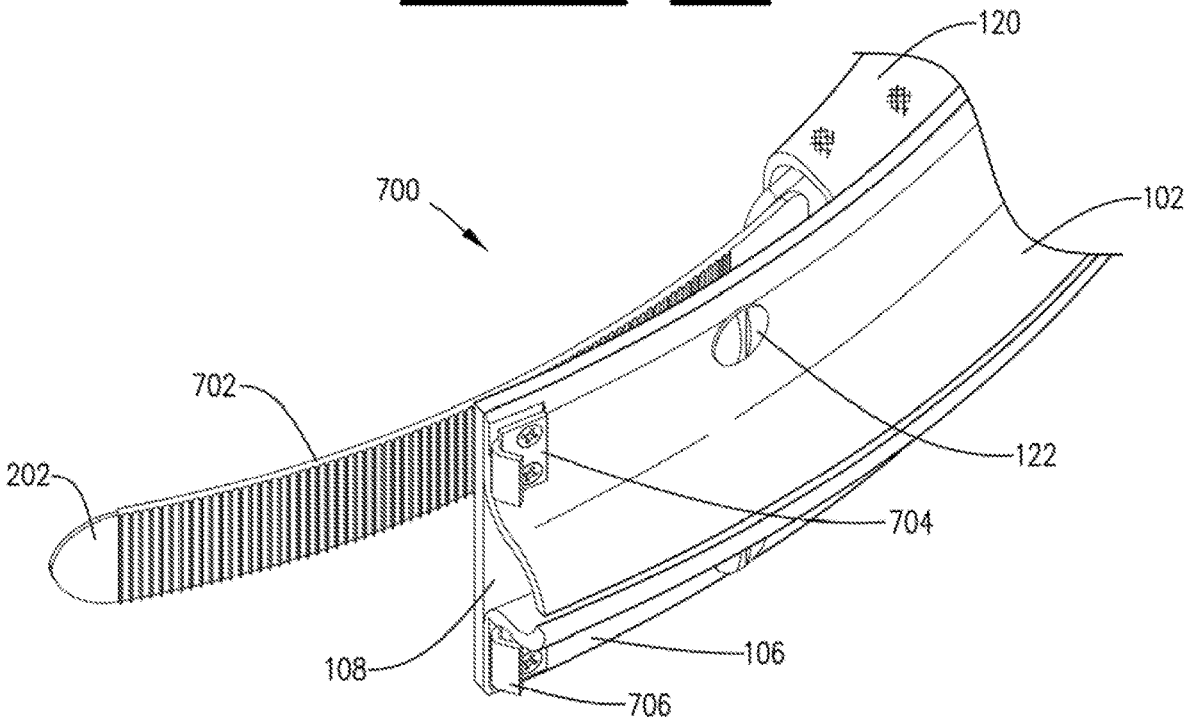
FIG. 7 is a perspective view of an embodiment of the draw latch retainer belt end.

The frame segments 105, 107 are releasably connected by a fastener connection, see, for example, FIGS. 6 and 7. The fastener connection includes a toggle latch 602, 604 on one of the second ends 113, 115, as shown in FIG. 5, of the frame segments 105, 107 and a latch strike 704, 706 on another of the second ends 113, 115 of the frame segments 105, 107.

The fastener connection includes two sets of fastener connections 602, 704, 604, 706. The sets include two toggle latches 602, 604 on one of the second ends 113, 115, as shown in FIG. 5, of the frame segments 105, 107 and two latch strikes 704, 706 on another of the second ends 113, 115 of the frame segments 105, 107. Each set is disposed on the axial outer portion 123, 125 of the shells 102, 104, 106, 302, and axially aligned with one connector set 122.

The waist belt 101 includes a strap 506, as shown in FIG. 5 and. In addition, the waist belt 101 includes a gear toothed end 202 and a releasable, self-locking, ratchet end 206.

The third part 109 (FIG. 2) comprises an elastic band. Opposing axial ends 127, 129 (FIG. 8) of the band 109 are disposed against a radial inner surface of the backer plate 802. The band ends 127, 129 are sandwiched between the backer plate 802 and rigid arcuate edge strips 502, and secured by the circumferentially spaced connectors 122.

The elastic band extends 109 circumferentially about the annular frame 103, and is segmented at the pivotal connection 112. With this configuration, when the training belt 100 is closed, the toothed end 202 and ratchet end 206 of the waist belt 101 are exposed, and the remainder of the waist belt 101 is between the elastic band 109 and the annular frame 103.

Turning to FIG. 10, padding inserts 904 may be provided, which are connectible on a radially internal facing surface of the elastic band 109 to further radially constrict the waist belt 101. The padding inserts 904 are connectable to the elastic band 109 via one or more of hook and loop connectors 1002, 1004 and stud and socket 1006, 1008 snap connectors.

Remaining with FIG. 10, the elastic band 109 may include one of hook and loop connectors 1002, 1004, the padding inserts 904 include one of stud and socket connectors 1006, 1008. Additionally, the training belt 100 includes an intermediate member 902 having another of the hook and loop connectors 1002, 1004 on a radial outer side, and another of the stud and socket connectors 1006, 1008 on a radial inner side. In this embodiment, the intermediate member 902 relatively easily connects the padded inserts 904 to the elastic band 109.

Figure 11:
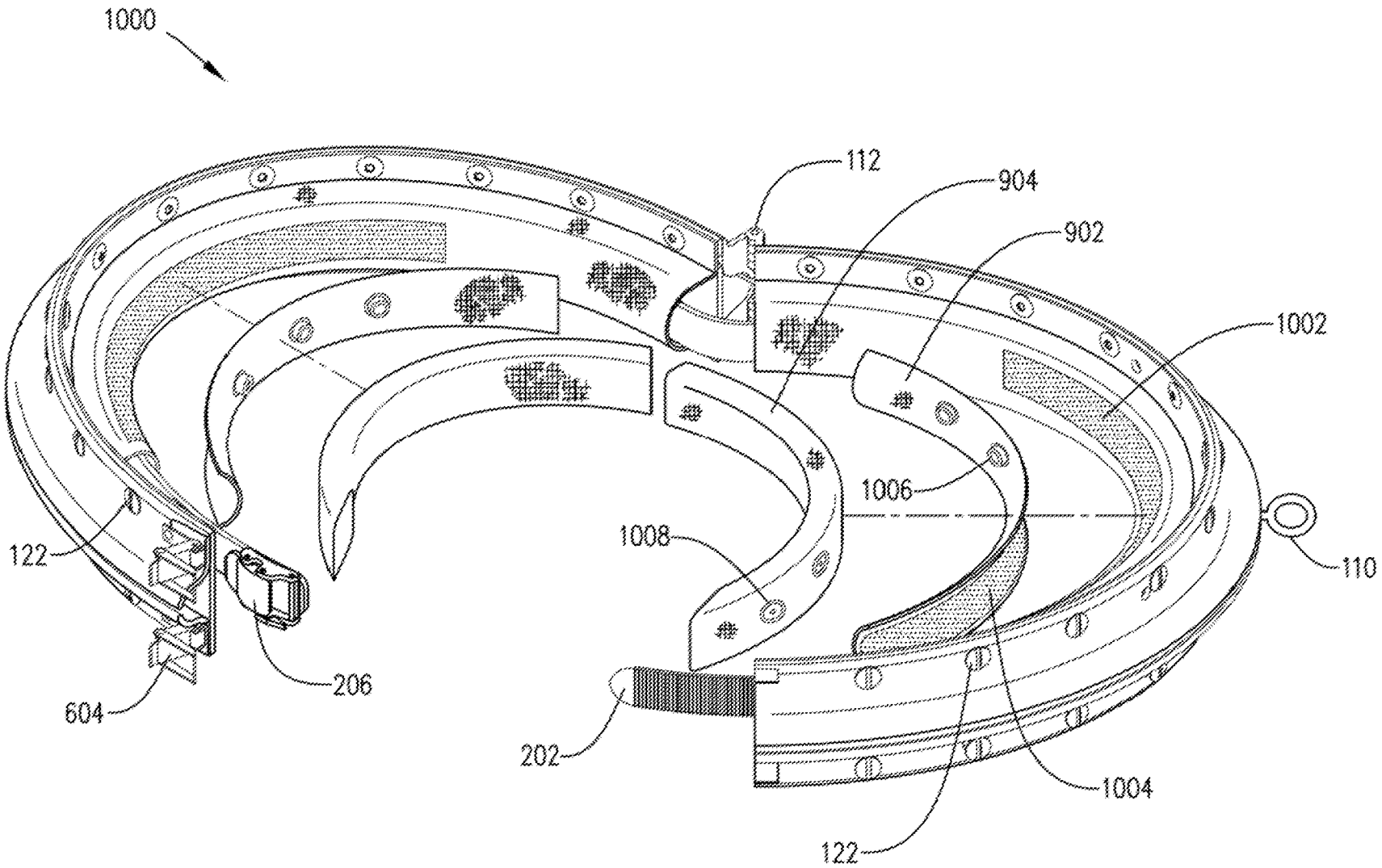
FIG. 11 is a top view of an embodiment of a resistance training belt with adjustable air bladders.
Figure 1:
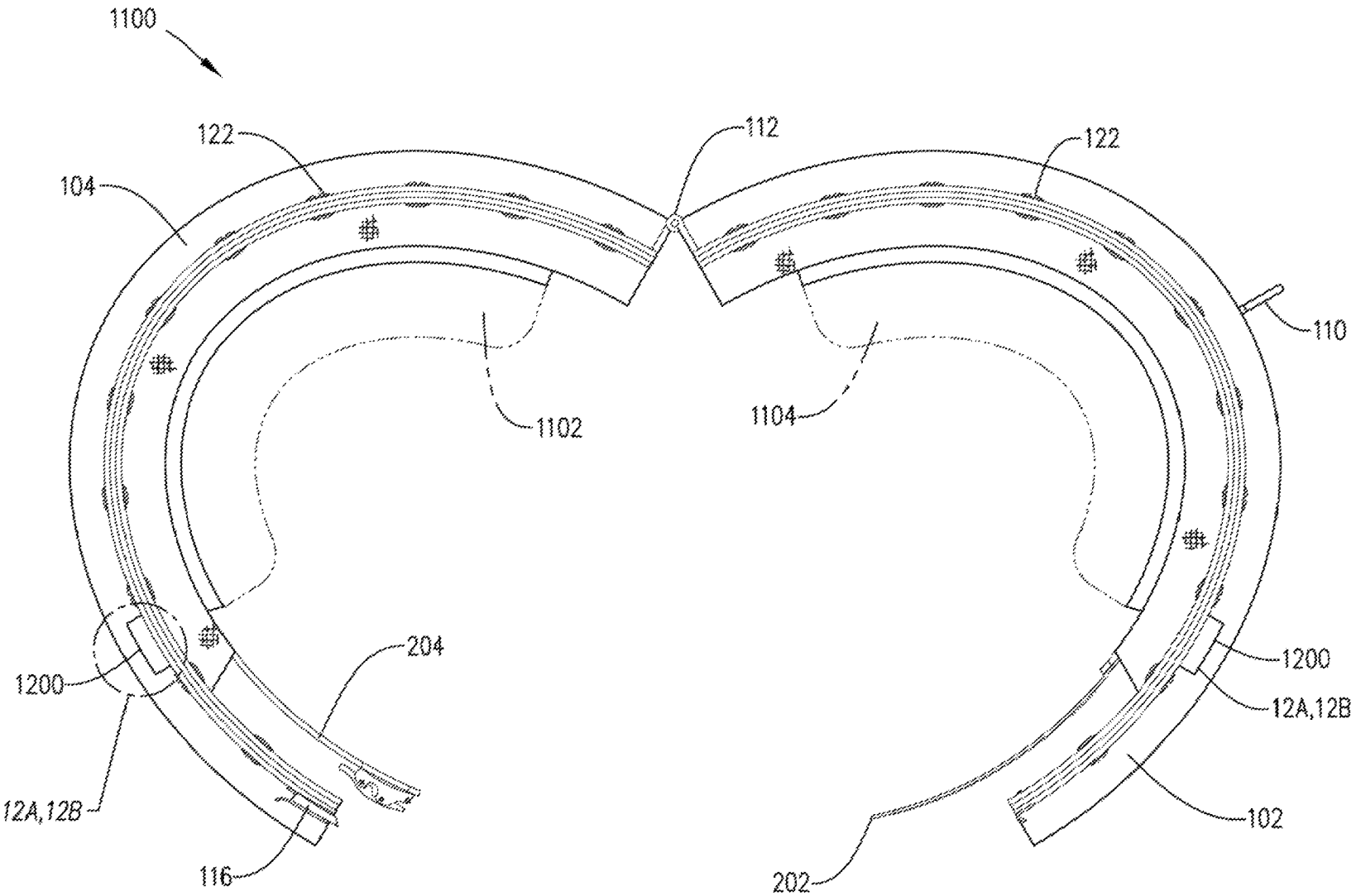

Turning to FIGS. 11-12 the training belt 100 may include an inflatable bladder 1102, 1104 disposed on a radially internal facing surface of the elastic band 109 to further radially constrict the waist belt 101. The inflatable bladder may include two inflatable bladders 1102, 1104, disposed on the radially internal facing surface of the elastic band 109 on each of the frame segments 105, 107.

A manually actuated air pump 1204 is provided for inflating and deflating each bladder 1102, 1104. Controls 1200 for the air pump 1204 are disposed on one of the axial upper shells 102, 104. The controls 1200 are proximate to the second end 113, 115 of the frame segments 105, 107.

The following further explanation of the disclosed embodiments provides a figure by figure explanation of the disclosed embodiments. To terminology used hereinafter is either the same as, or synonymous with, the terminology used hereinabove.

FIG. 1 is a perspective view of a resistance belt 100. The resistance belt 100 may comprise an upper left track 102, an upper right track 104, a lower left track 106, lower right track 302, track space 108 defined therebetween, the trackball 804 with the mechanical connector 110 (illustrated as an eyelet), an upper hinge 112, a lower hinge 304 (not shown), an upper draw latch 116, a lower draw latch 114, a right side elastic member 118, a left side elastic member 120, and track fasteners 122.

The resistance belt 100 has a left section and a right section that are attached by hinges 112 and 304. These hinges 112, 304 facilitate donning the resistance belt 100 by the user opening the resistance belt 100 sufficiently and placing the resistance belt 100 around the waist of the user. The separated ends of the sections of the resistance belt 100 are then brought together where the resistance belt 100 is secured in place by a belt 506, buckle 206, and draw latches 114,116. The belt 202 and buckle 206 will be described later in FIGS. 6 and 7.

The draw latches 114, 116 secure the resistance belt 100 to the user which provides a continuous annular (360 degrees) track around the user. The trackball 804 is held in place by upper tracks 102, 104 and lower tracks 106, 302 that are separated such that the tracks create the track space 108 wherein the trackball 804 and the associated the mechanical connector 110 freely move. The tracks 102, 104, 106, 302 may be selected from materials including but not limited to synthetic polymers, metals, plastics, and composites. The left section comprises an upper left track 102 and a lower left track 106 that defines the track space 108 that becomes continuous from the left track section to the right track section when the latches 114, 116 are closed. The right section is constructed in a similar fashion so to allow the trackball 804 to move freely around the track without binding.

Multiple track fasteners 122 attach the upper left track 102, the upper right track 104, the lower left track 106, and the lower right track 302 to the resistance belt 100. The track fasteners 122 are spaced to prevent the track tracks 102, 104, 106, 302 from separating from the resistance belt 100 and maintaining the track space 108 under normal loading conditions. The track fasteners 122 may be selected from screws, rivots, or other methods of attachment apparent to one skilled in the art.

In the present embodiment, the resistance belt 100 is secured in place around the user using a belt 506 and buckle 206 and elastic members 118, 120 affixed to the resistance belt 100. In a preferred embodiment, the retaining materials 118, 120 are elastic such that the resistance belt may be utilized by multiple users of varying sizes. This combination of fasteners prevents the resistance belt 100 from moving around the user during the training activity. The right side elastic member 118 and the left side elastic member 120 may be affixed to the resistance belt 100 wherein a cavity may be created such that the belt 506 resides within the cavity of both sides, and that the tongue 202 of the belt 506 and the buckle 206 meet at the opening of the resistance belt 100 created by the hinging action.

A user places the resistance belt 100 around their waist and secures the belt 506 around the waist using the tongue 202 and the buckle 206. If the user is smaller then the elastic member 118, 120 may stretch to allow the user to secure the belt 506 tightly around their waist. The user then connects the two section using draw latches 114, 116. Once the resistance belt is securely fastened around the user then a elastic training strap 1318 may be connected to the the mechanical connector 110 for the desired training. The elastic member 118, 120 may be constructed from materials including, but not limited to, natural rubber and a polymer based on chloroprene, isobutylene, and isoprene.

FIG. 2 is a top view 200 of the resistance training belt 100. This view illustrates the buckle 206, the buckle attachment 204 and the belt 506 (not shown) and tongue 202 in their latched configuration. The buckle 206 and belt 506 are further described in FIGS. 6 and 7. After placement of the resistance belt 100 in the user's desired location which is typically around the waist, the user may adjust and secure the belt 506 by inserting the tongue 202 of the belt 506 into the buckle 206 and tightening to the desired level by the user wherein the user engages the buckle 206 to the belt 506 to retain the belt 506 in the desired position. The right side elastic member 118 and the left side elastic member 120 may stretch to accommodate this adjustment by the user. This adjustment allows the resistance belt 100 to be sized to various size users without creating a specific resistance belt 100 track diameter for each user.

FIG. 3 is the bottom view 300 of a resistance training belt 100. This view highlights the lower right track 302 that was hidden in the perspective view in FIG. 1. The lower right track 302 identical to the lower left track 102. In the preferred embodiment, the tracks 102, 104, 106, 302 may be interchangeable to simplify the design and reduce the overall cost. This view 300 also illustrates the companion hinge 304 for the lower tracts 106, 302 of the resistance belt 100. By having two hinges 112, 304, a continuous track space 108 may be created without hinges interfering with the trackball 804 during its 360 degree continuous travel. Additionally, the hinge 304 provides additional strength and improves the transition of the trackball 804 from one section to another.

FIG. 4 is a side view 400 of the resistance training belt 100. The upper track 102, 104 and the lower track 106, 302 are affixed to the resistance belt 100 with a plurality of track fasteners 122 defining the track space 108 there between. This view 300 shows the the mechanical connector 110 protruding from the track space 108 wherein the trackball 804 can be viewed inside the track space 108. The track space 108 allows the trackball 804 and the mechanical connector 110 to move freely around the entirety of the track of the resistance belt 100 without any interference or having to stop to reposition the training strap 1318.

A user may want to limit the movement of the trackball 804 to a specific section of the track and may do so by using the track stop 404*a*, that includes a washer 406, and a wingnut 402 as seen in FIG. 4A. In the preferred embodiment, the track stop 404*a* may comprise an anchor ball 404 similar to the trackball 804 with a threaded section that protrudes past the tracks with sufficient length to accept the washer 406 and the wingnut 402. The wingnut 402 is configured for being sufficiently tightened to secure the track stop 404*a* in the desired position. It would be apparent to one skilled in the art of other designs that would perform the same function.

The user may insert two track stops 404*a*, 404*b* into the track space 108 and they are placed on either side of the trackball 804 and secured in place by the wingnuts 402. The track stops 404*a*, 404*b* may limit the movement of the trackball 804 within the desired area where the track stops 404*a*, 404*b* are placed and secured to the resistance belt 100. These track stops 404*a*, 404*b* may be removed by opening up the resistance belt 100 and moving them to one of the ends and disengaging them from the resistance belt 100. A user may insert the multiple track stops (e.g., the two track stops 404*a*, 404*b*) within the belt track space 108 and also insert multiple trackballs (including the trackball 804, which is illustrated in the figures), with respective the mechanical connectors (including the mechanical connector 110, which is illustrated in the figures) if they want to use the resistance belt 100 in a semi-fixed condition while training.

Additionally, this view illustrates arm band connecting points 408 and leg band connecting points 410 where a user may desire to attach to the legs and/or arms additional resistance bands that may be elastic to increase the training of the user. The addition of the leg and arm bands is further illustrated in FIG. 13.

FIG. 5 is a perspective view 500 of an open resistance training belt 100. This view illustrates the interior upper right retainer 504 that secures the top of the right side elastic member 118 to the resistance belt 100 and the interior upper left retainer 502 that secures the top of the left side elastic member 120 to the resistance belt 100. The belt 506 enters into the cavity of the right elastic member 118 at the proximal end and extends all the way through the cavity and exits the distal end of the right elastic member 118 then crosses the hinged area and enters the distal end of the left side elastic member 120 wherein the belt 506 exits the proximate end of the left side elastic member 120. The buckle 206 and the tongue 202 appear at the proximate ends of the elastic members 118, 120 near the opening of the resistance belt 100. Alternatively, the belt 506 is a draw-cord and does not contain the tongue 202 and the buckle 206 at opposing ends.

FIG. 6 is a detailed view 600 of the draw latches mounted on the resistance belt 100. In this view, the upper draw latch connector 602 and the lower draw latch connector 604 are shown affixed to the upper track 104 and lower track 106 on the resistance belt 100 where these draw latch connectors 602, 604 are components of draw latches 114 and 116 respectively. The draw latch connectors 602, 604 may be affixed to the resistance belt 100 by many methods available to one skilled in the art, including, but not limited to, screws, bolts, and rivets. To secure the draw latch 114, the draw latch connector 602 is placed on the upper draw latch retainer 704 and the lower draw latch connector 604 is placed on the lower latch retainer 706 and then the draw latch connectors 602, 604 are pulled away from the retainers 704, 706 and toward the resistance belt 100 securing and locking the draw latches 114, 116 in place on the resistance belt 100.

FIG. 7 is a detailed view 700 of the draw latch retainer side of the resistance belt 100 illustrating the upper latch retainer 704 and the lower latch retainer 706 that were described previously in FIG. 6. Upon attaching the upper draw latch connector 602 to the upper latch retainer 704 and the lower draw latch connector 604 to the lower latch retainer 704 and securing both draw latches 114,116, a continuous path is provided for the trackball 804 to freely move 360 degrees around the user. The retainers 704 and 706 are fixedly attached to the upper and lower tracks 102 and 106 and may be affixed to the resistance belt 100 by many methods available to one skilled in the art including, but not limited to, screws, bolts and rivets.

In a preferred embodiment, the tongue 202 has serrated teeth 702 to prevent the belt 506 from moving once the buckle 206 has engaged the serrated teeth 702. The user inserts the tongue 202 into the buckle then adjusts to the desired size and once it is appropriately adjusted to the user's waist then the locking mechanism on the buckle 206 is engaged which engages the serrated teeth 702 on the tongue 202. This buckle 206 and tongue 202 engagement holds the belt 506 in place, thus preventing the belt 506 from coming loose during the resistance training belt's 100 operation.

FIG. 8 is a cross sectional view of the resistance training belt 100. In a preferred embodiment, the upper track 102 is affixed to a separator panel 802, the elastic member 120 and an interior upper left retainer 502 where a track fastener's 122 proximate end engages the upper track 102 and protrudes through the above described parts and the fastener's 122 distal end is secure by a nut to prevent release of the materials. The above described process is repeated to create the lower half of the track section. Once the section halves are assembled the track space 108 becomes more apparent. As viewed, the belt 506 resides within the elastic member 120 and the elastic member may stretch depending on the size of the user until the belt 506 tightens around the user's waist or other selected body part.

Figure 8B:
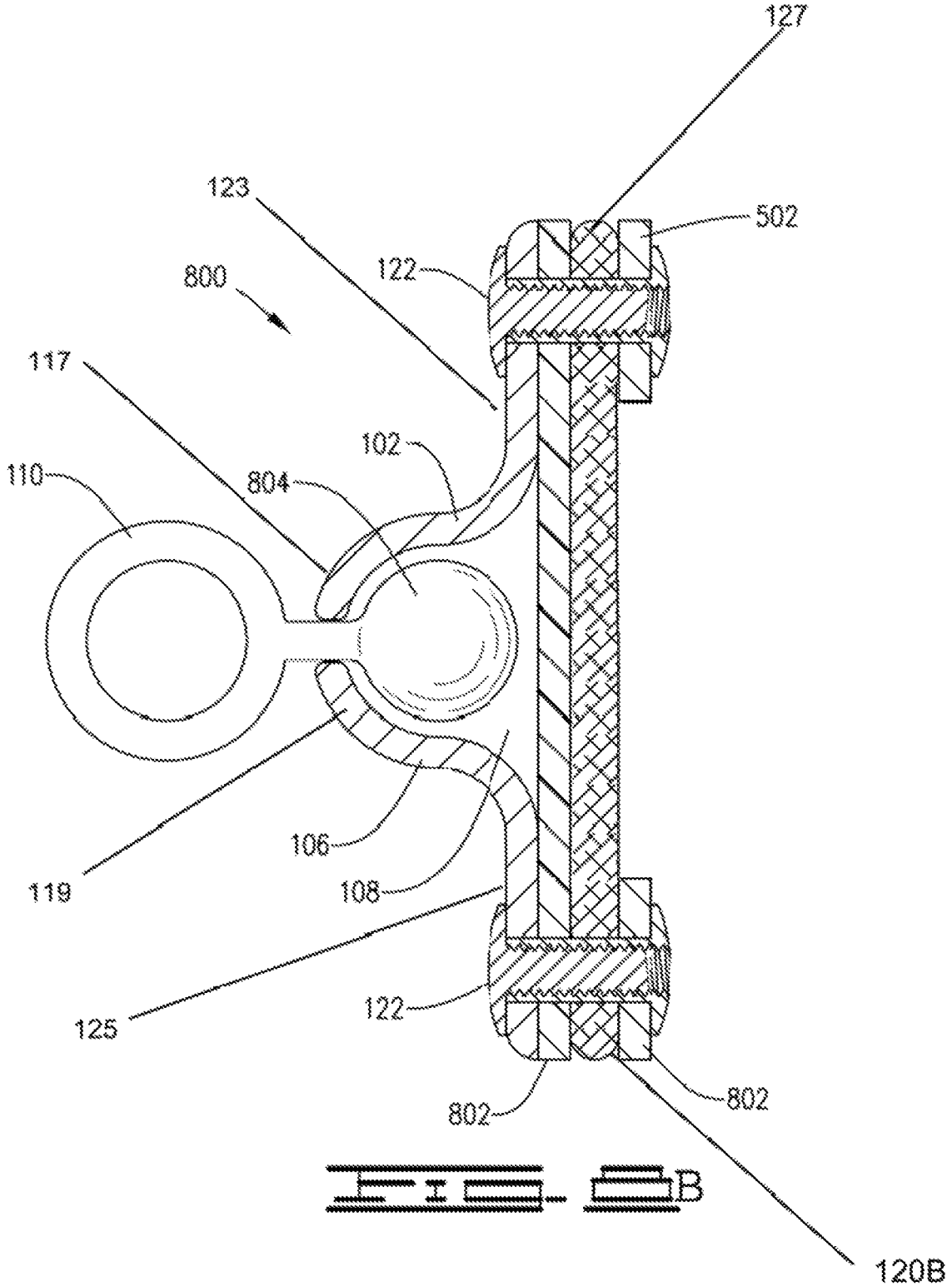
FIG. 8B is a cross-sectional view of an alternative embodiment for the resistance training belt.

FIG. 8B illustrates an alternative in which member 120B is a layer of foam that is connected to the panel 802 and member 120B is pressed against the skin of a user as a cushion. Yet alternatively, upper track 102, lower track 106 and panel 802 are manufactured as a unitary member (not illustrated), e.g. by metal forging. The cross section of such alternative would be similar to that in FIG. 8B with member 120B is similarly connected as in FIG. 8B.

Additionally, the trackball 804 resides within the tracks 102, 106 with the stem and the mechanical connector 110 protruding from the track space 108 such that a training strap 1318 may be connected. The stem and the mechanical connector may be coated with a low friction material to prevent wear as the trackball 804 moves about the track. The trackball 804 freely moves within the track space 108 throughout the full circumference of the resistant belt 100. The trackball 804 may be constructed from materials including, but not limited to, synthetic polymers, metal, plastic, and composites or other materials that reduces resistance and facilitate movement. Additionally, the trackball 804 may be one material (for example steel) coated with another, such as a polymer.

Figure 9:
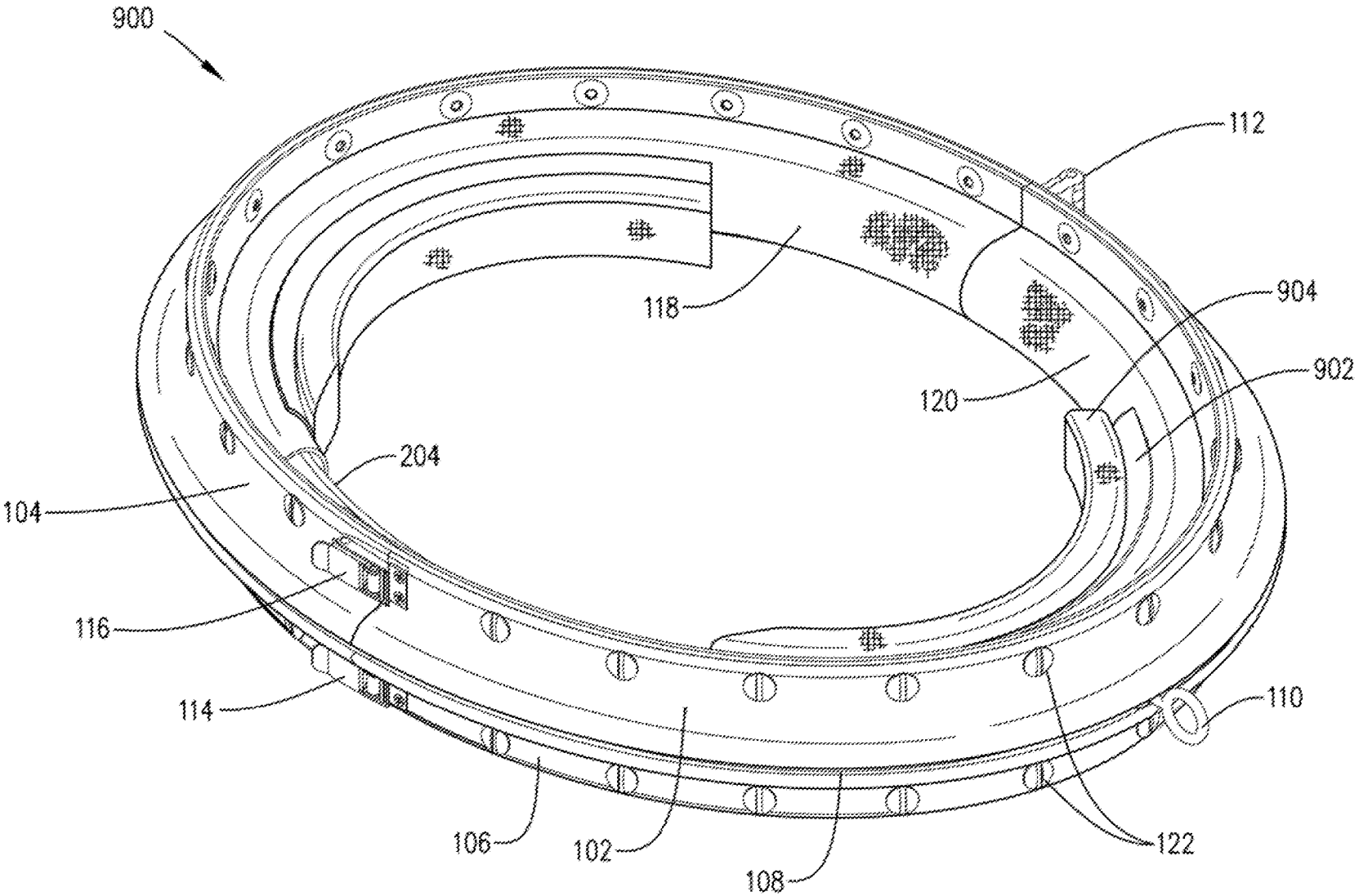
FIG. 9 is a perspective view of an embodiment of a resistance training belt with adjustable padding.

FIG. 9 is a perspective view of an adjustable padding resistance training belt 900 which is alternative embodiment of the above described resistance training belt 100. In this embodiment, the method for securing the adjustable padding resistance training belt 900 around the user is to select different sized pad inserts 904 to fit the user instead of using a belt 506 to secure the resistance belt 100 around the body of the user as described above. The padding inserts 904 may vary in size to accommodate users with various sized waists by providing plurality of pad insert 904 sizes to fit their waist. The pad insert 904 is placed between the user and the pad interface 902 that is fixedly attached to the elastic member 118,120. The padding insert 904 may be selected from materials, including, but not limited to, high density foam, low density foam, cloth, rubber, leather, strapping, plastic, and para-aramid synthetic fiber.

Figure 9B:
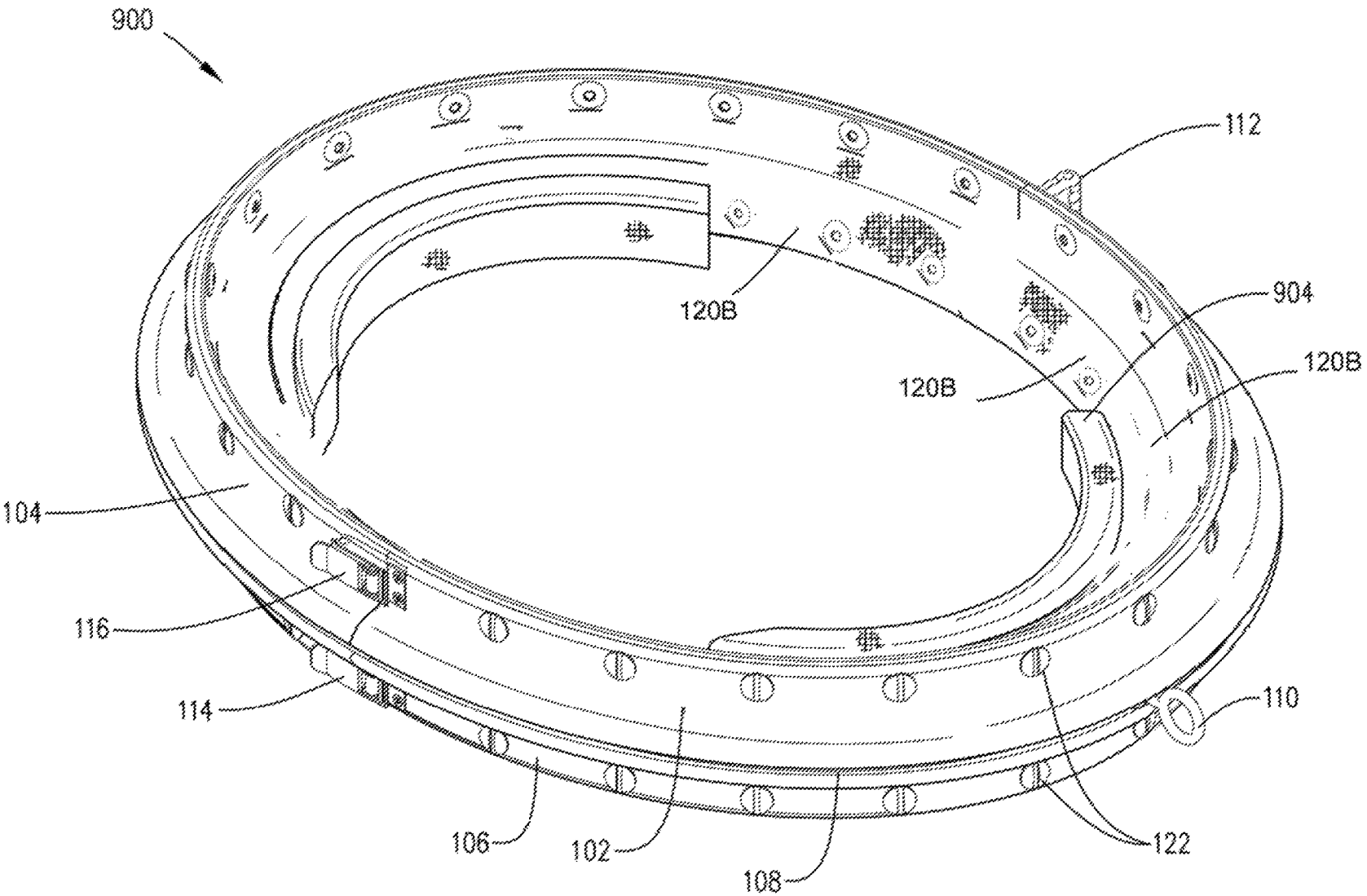
FIG. 9B is a perspective view of an alternative embodiment of a resistance training belt with adjustable padding.

FIG. 9B illustrated a perspective view of the embodiment of FIG. 8B. Adjustable padding 904 is directly connected to the cushion member 120B via, e.g., hook and loop connectors.

FIG. 10 is an exploded view 1000 of an open adjustable padding resistance training belt 900. The adjustable padding may comprise a pad interface 902 with hooks 1002, loops 1004 and studs 1006, adjustable padding inserts 904 with sockets 1008. The pad interface 902 may be removably attached to the elastic members 118, 120 using hooks and loops or by other methods that would be apparent to one skilled in the art to removably attach materials. In the alternative, the pad interface 902 may be permanently affixed to the elastic member 118, 120 by an affixation means including, but not limited to sewing, gluing or other known affixation methods apparent to one skilled in the art. The adjustable padding resistance training belt 900 provides for quick and easy removal and replacement of the adjusting pad inserts 904 so a single adjustable padded resistance training belt 900 may be used for a plurality of individual users requiring only a plurality of adjusting pad inserts 904. While shown only on the sides, adjustable padding inserts could be provided for the back and/or front portions as well.

FIG. 11 is a top view of an inflatable resistance-training belt 1100. The inflatable resistance-training belt 1100 may comprise a right-side air bladder 1102, a left side air bladder 1104, and a bladder control 1200. The bladder control 1200 will be described later in FIG. 12. In this embodiment, the user places the inflatable resistance-training belt 1100 around their body wherein the user latches the two sections using the draw latches 114, 116. Once the inflatable resistance-training belt 1100 is securely fastened around the user, the user may use the control box 1200 to pump air into the air bladders 1102, 1104 to inflate them to the desired level so they tightly affix to the body preventing the movement of the resistance-training belt 1100. After a user has completed the activity using the inflatable resistance-training belt 1100, the user may use the control box 1200 to deflate the air bladders 1102, 1104 to allow for easy removal of the inflatable resistance-training belt from the user.

Figure 12A:
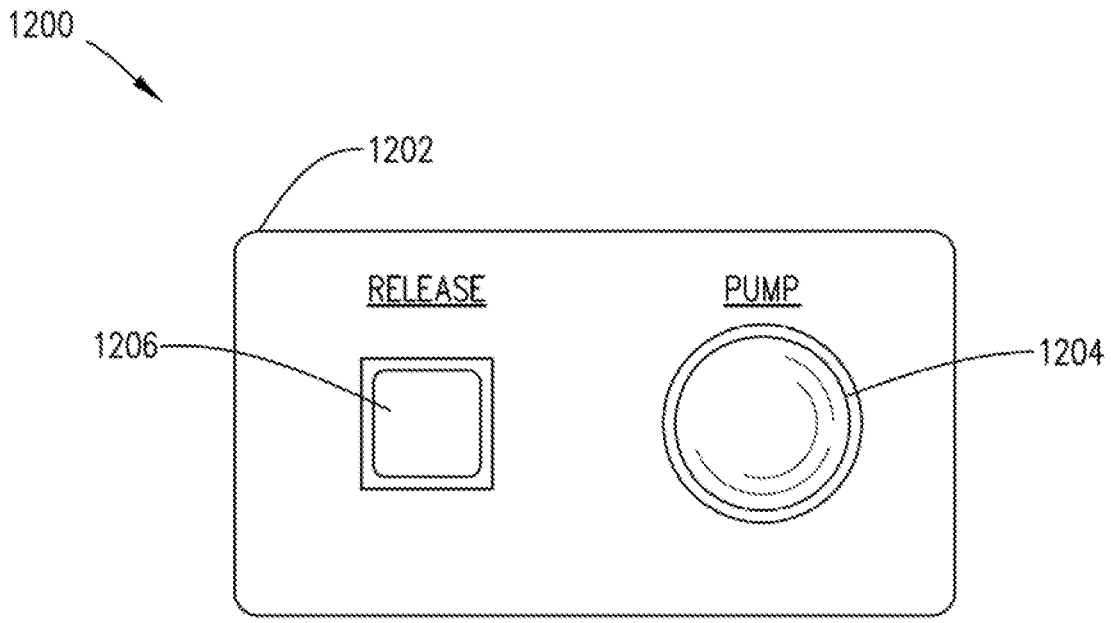
FIG. 12A is a front view of an embodiment of a bladder controller.
Figure 12B:
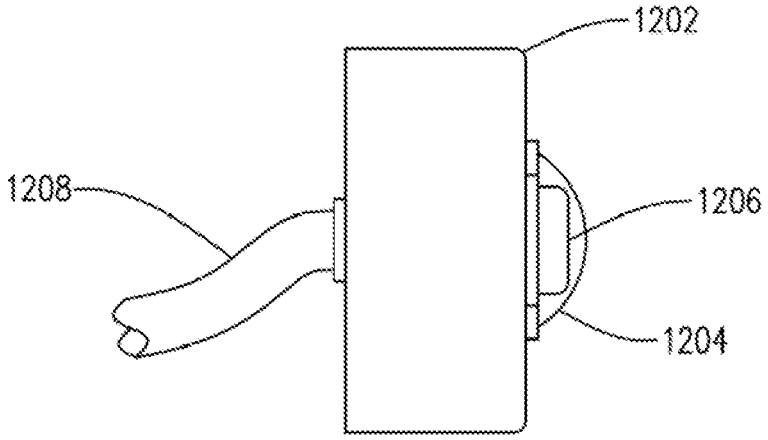
FIG. 12B is a side view of the bladder control.

FIG. 12 is two views of the bladder control 1200 with FIG. 12A being the front view of the bladder control 1200 and FIG. 12B being the side view of the bladder control 1200. The bladder control 1200 may comprise a control box 1202, a pump button 1204, a release button 1206, and the bladder control tubing 1208. As described earlier, once a user has secured the inflatable resistance training belt 1100 around their body, the user may pump up the air bladders 1102 and 1104 by multiple depressions of the pump button 1204 to fill the air bladders with air.

This method of filling the bladders 1102, 1104 is but one method used but the other methods are hereby incorporated by reference and would be apparent to one skilled in the art. Alternative methods to inflate the bladders may include, but are not limited to a micro-electric air pumps and compressed air. Additionally, the air bladders 1102, 1104 may be partially filled by an external source wherein the pump button 1204 is used to fine-tune the amount of air inside the bladders 1102, 1104 to correctly fit the user.

After a user has completed their training and desires to remove the inflatable resistance-training belt 1100, user presses the release button 1206 which allows the air to escape the bladders 1102, 1104. The amount of air that is released may depend on how long the release button 1206 is held and also how much pressure is placed upon the air bladders 1102, 1104. The release button 1206 and the pump button 1204 are housed in the control box 1202 which is affixed to the resistance training belt.

This affixation may be accomplished through hooks and loops or other fasteners but it would be apparent to one skilled in the art the type of affixation method required to attach the control box 1202 to the inflatable resistance-training belt 1100. FIG. 12B shows the side view of the control box 1202 wherein it can be seen that a tube 1208 exits the control box 1202 and then is fluidly connected to the right side and left side air bladders 1102 and 1104. A resistance belt may have a single control box 1202 to control both bladders or may have two control boxes 1202 on for each bladder 1102, 1104.

FIG. 13 shows a resistance training belt 100 mounted to a user optional with arm and leg resistance bands. The resistance training belt 100 and the different embodiments may also utilize elastic leg and arm bands 1304, 1312 for additional resistance training. The elastic arm band 1304 has a distal end affixed to the upper resistance belt connector 1302 and the proximal end affixed to the arm band connector 1306. The elastic arm band 1304 may provide the user varying degree of resistance based on the size of the elastic arm band 1304 and the materials used for construction. The elastic arm band's 1304 distal end is attached to the resistance training belt 100 at 408 using upper resistant belt connectors 1302.

The elastic arm band's 1304 proximal end is attached to the arm band 1308 by the arm band connector 1306 wherein the arm band 1308 is placed around the user's wrist. Single or double arm bands 1308 may be used during training depending on the type of training that the user is receiving. The resistance belt 100 is configurable to one or two arm bands 1308.

The resistance training belt 100 may also be configured to add elastic leg bands 1312 to increase the user training. The elastic leg band 1312 has a distal end affixed to the lower resistance belt connector 1310 and the proximal end affixed to the leg band connector 1314. The elastic leg bands 1312 distal end may be attached to the resistance belt 100 at the leg strap connecting points 410 using the lower resistance belt connector 1310. The proximal end of the elastic leg band 1312 may be connected to the leg band 1316 placed near the ankle of the user. A user may utilize a single leg band 1312 or two leg bands 1312 or no leg bands at all while training using the resistance training belt 100.

A trainer may also connect the distal end of the elastic training strap 1318 to the the mechanical connector 110 on the resistance belt 100. The proximal end of the elastic training strap 1318 is connected to a ring 1320. The trainer may use a handle 1324 that has a handle release button 1326 that activates the release 1322 that opens the release such that it allows the elastic training strap 1318 to disengage from the handle 1324.

To accomplish this, the release 1322 may be connected to the ring 1320 to securely engage the ring 1320 until such time as the trainer decides to depress the handle release button 1326 and activate the release 1322, which then disengages from the ring 1320 allowing the user to move freely without resistance. This allows a trainer to increase the amount of resistance to the resistance training belt 100 as the user is performing athletic maneuvers such as a wide receiver running a passing pattern. At such time if the resistance becomes too great, the trainer can release the elastic training strap 1318 allowing the user to freely move without resistance.

The disclosed embodiments allow a user to train without the need to constantly reposition a strap depending on the exercise to be performed and also allow the user to engage in more realistic dynamic training dependent on the sport while avoiding negative learning. The apparatus may consist of a 360 degree track encircling the user's body, an adjustable belt and lining to firmly fit a range of users, a method for securing the track around the body, and a trackball assembly for connecting to a training strap with a load. The training strap may be affixed to stationary objects or a releasable handle that can be gripped by a trainer to act as load.

For example, the disclosed embodiments find particular advantage for training football receivers who rotate their bodies to receive a football, and running backs who constantly rotate their bodies while running to change their angle of attack. A tennis player could practice volleys while working against a load. Above are a few examples of the advantages of dynamic realistic training in a specific sport, the disclosed embodiments have application throughout many sports, general health and fitness, and physical therapy.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

The terminology used herein is for the purpose of describing particular embodiments only and is not intended to be limiting of the present disclosure. As used herein, the singular forms "a", "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A training belt for athletic training, the training belt comprising:

a first part comprising a radially internal portion configured for being positioned against a waist of a user;

a second part connected to the first part, the second part being an annular frame that is radially external and rigid, wherein the annular frame comprises:

a track that is annular;

a mechanical connector that is configured to slidably move about the track; and an aperture configured to connect with athletic training equipment, wherein the annular frame comprises frame segments that move relative to each other, and wherein the training belt is reversibly closable to form an annular loop, wherein the frame segments include a first frame segment and a second frame segment, wherein the first frame segment and the second frame segment are connected at a pivotal connection at a first circumferential end of each of the first frame segment and the second frame segment, wherein each of the first frame segment and the second frame segment comprises:

a backer plate on a radial inner side of the annular frame; and an axial upper shell and an axial lower shell, the axial upper shell and the axial lower shell both disposed on a radial outer side of the annular frame and connected to the backer plate to provide an annular gap at an axial center of the training belt to form the track, wherein axial adjacent portions of the axial upper shell and the axial lower shell include a substantially quarter-circle profile that is substantially constant along the annular track, and wherein the annular frame comprises a trackball disposed on a radial inner side of the track, the trackball comprising a stem that extends radially through the track and connects with the mechanical connector.

2. The training belt of claim 1, wherein the first frame segment and the second frame segment are releasably connected at a second circumferential end of each of the first frame segment and the second frame segment.

3. The training belt of claim 2, wherein the first frame segment and the second frame segment have a same circumferential span.

4. The training belt of claim 1, further comprising pair of anchor balls disposed on the radial inner side of the track, each with a stem that extends radially through the track and connects with a butterfly nut, to limit a travel span of the mechanical connector in the track.

5. The training belt of claim 4, wherein the axial upper shell and the axial lower shell and the backer plate are connected by circumferentially spaced connectors.

6. The training belt of claim 4, wherein the axial upper shell and the axial lower shell and the backer plate are connected by two sets of circumferentially spaced connectors, wherein a first connector set of the circumferentially spaced connectors is disposed on an axial outer portion of the axial upper shell and the axial lower shell, respectively, and axially adjacent to the respective substantially quarter-circle profile.

7. The training belt of claim 6, wherein the aperture includes eight of the apertures, pairs of which are disposed on the axial upper shell and the axial lower shell, axially aligned with each set of the circumferentially spaced connectors, and circumferentially spaced about each shell so that each of the apertures in the axial upper shell is axially aligned with each of the apertures the axial lower shell.

8. The training belt of claim 7, wherein the first frame segment and the second frame segment are releasably connected to one another by a fastener.

9. The training belt of claim 8, wherein the fastener comprises a toggle latch on one end of the frame segments and a latch strike on another end of the frame segments.

10. The training belt of claim 9, wherein the fastener comprises at least two sets of fasteners, wherein the at least two sets of fasteners comprises at least two toggle latches on the one end of the frame segments and at least two latch strikes on said another end of the frame segments, each set of fasteners being disposed on the axial outer portion of the axial upper shell and the axial lower shell and axially aligned with at least one set of fasteners.

11. The training belt of claim 10, wherein the radially internal portion is a waist belt that comprises a strap with a gear toothed end and a ratchet end that is releasable and self-locking.

12. The training belt of claim 11, wherein a third part of the training belt comprises an elastic band, opposing axial ends of which are disposed against a radial inner surface of the backer plate, sandwiched between the backer plate and rigid arcuate edge strips, and secured by the circumferentially spaced connectors.

13. The training belt of claim 12, wherein the elastic band extends circumferentially about the annular frame, and is segmented at the pivotal connection, so that when the training belt is closed, the gear toothed end and ratchet end of the waist belt are exposed, and a remainder of the waist belt is between the elastic band and the annular frame.

14. The training belt of claim 13, further comprising a padding insert that is connectible on a radially internal facing surface of the elastic band to further radially constrict the waist belt, the padding insert being connectable to the elastic band via one or more of hook and loop connectors and stud and socket snap connectors.

15. The training belt of claim 14, wherein the elastic band includes one of the hook and loop connectors, the padding insert includes one of stud and socket connectors, and the training belt further comprises an intermediate member having another of the hook and loop connectors on a radial outer side and another of the stud and socket connectors on a radial inner side, thereby connecting the padding insert to the elastic band.

16. The training belt of claim 15, further comprising an inflatable bladder disposed on the radially internal facing surface of the elastic band to further radially constrict the waist belt, and an air pump that is adjustable and configured to inflate and deflate the inflatable bladder.

17. The training belt of claim 16, wherein the inflatable bladder includes at least two inflatable bladders, which are disposed on the radially internal facing surface of the elastic band on each of the frame segments.

18. The training belt of claim 17, wherein a control for the air pump is disposed on at least one of the axial upper shell and the axial lower shell and proximate to one end of the frame segments.

19. An athletic training apparatus comprising:

a. an adjustable system comprising:

i. a strap with a serrated portion at a first end;

ii. a releasable, self-locking, ratchet rigidly fixed to a second end of the strap and comprising a buckle which engages the serrated strap end; and iii. an elastic member at least partially encircling the strap;

b. a track disposed outside of the adjustable system, the track comprising:

i. at least two semicircular rigid members;

ii. at least two upper sections that are rigid and are hingedly attached to one another;

iii. at least two lower sections that are rigid and are hingedly attached to one another;

iv. a track cavity defined by rigidly affixing the upper sections and the lower sections to the semicircular rigid members with sufficient spacing between the upper sections and the lower sections and adapted to receive a trackball therein allowing free movement around the track; and v. an upper latch fixedly attached to the upper sections and a lower latch fixedly attached to the lower sections and adapted to draw section ends of the upper sections and the lower sections together, creating a continuous track;

c. a roller assembly including the trackball received within the track cavity affixed to an eyelet that extends outside the track cavity; and d. circumferentially spaced connectors attaching the adjustable system to the track.

20. The athletic training apparatus of claim 19, further comprising a pad affixed to the track, wherein an internal circumference of the pad is adjustable, and whereby the internal circumference of the track is therefore adjustable.

21. The athletic training apparatus of claim 20, wherein the pad is releasably affixed to the athletic training apparatus.

22. A training belt for athletic training, the training belt comprising:

first and second frame segments, each forming a circumferential half of an annulus and each including half of an annular track, the first and second frame segments pivotally connected to one another at one circumferential end and releasably connected to one another at another circumferential end, wherein, when the training belt is closed, a continuous annular frame is formed by the training belt, and a continuous annular track is formed about the training belt;

the training belt further comprising:

a mechanical connector that is configured to slidably move about the continuous annular track, and a trackball disposed on a radial inner side of the continuous annular track, the trackball comprising a stem that extends radially through the continuous annular track and connects with the mechanical connector; and first and second track stops, each including an anchor ball, disposed within the continuous annular track, the first and second track stops configured for being anchored on opposing circumferential sides of the trackball for limiting circumferential movement of the trackball about the continuous annular track.

23. The training belt of claim 22, wherein the continuous annular frame includes:

a first part comprising a radially internal portion configured for being positioned against a waist of a user;

a second part connected to the first part, the second part being radially external and rigid, the second part forming the continuous annular track.

24. The training belt of claim 23, wherein the second part includes first and second axial upper shells and first and second axial lower shells, each defining a substantially quarter circle cross section and being axially spaced from one another to form the continuous annular track.

25. The training belt of claim 23, wherein the first part is elastic.

26. The training belt of claim 25, wherein an adjustable belt is disposed within the continuous annular frame, radially against the first part, and the adjustable belt is configured for tightening the first part against the waist of the user.

* * * * *